US011286737B2

(12) United States Patent
Gunasekaran

(10) Patent No.: US 11,286,737 B2
(45) Date of Patent: Mar. 29, 2022

(54) FLUID-FREE HYDRAULIC CONNECTOR

(71) Applicant: HALLIBURTON ENERGY SERVICES, INC., Houston, TX (US)

(72) Inventor: Mohan Gunasekaran, Rio De Janerio (BR)

(73) Assignee: Halliburton Energy Services, Inc., Houston, TX (US)

( * ) Notice: Subject to any disclaimer, the term of this patent is extended or adjusted under 35 U.S.C. 154(b) by 268 days.

(21) Appl. No.: 16/609,392

(22) PCT Filed: Dec. 28, 2018

(86) PCT No.: PCT/US2018/067841

§ 371 (c)(1),
(2) Date: Oct. 29, 2019

(87) PCT Pub. No.: WO2020/139367

PCT Pub. Date: Jul. 2, 2020

(65) Prior Publication Data

US 2021/0332655 A1 Oct. 28, 2021

(51) Int. Cl.

| | |
|---|---|
| ***E21B 23/04*** | (2006.01) |
| ***E21B 17/06*** | (2006.01) |
| ***E21B 17/02*** | (2006.01) |

(52) U.S. Cl.

CPC ..... *E21B 23/042* (2020.05); *E21B 17/026* (2013.01); *E21B 17/06* (2013.01); *E21B 23/0421* (2020.05)

(58) Field of Classification Search

CPC ..... E21B 23/042; E21B 17/06; E21B 17/026; E21B 23/0421; E21B 23/04

See application file for complete search history.

(56) References Cited

U.S. PATENT DOCUMENTS 4,460,039 A * 7/1984 Knight ..... E21B 34/02 166/379
6,145,596 A * 11/2000 Dallas ..... E21B 19/086 166/379

(Continued)

FOREIGN PATENT DOCUMENTS

GB 2459952 11/2009
GB 2459952 A 11/2009

OTHER PUBLICATIONS

PCT/US2018/067841, "International Search Report and Written Opinion", dated Sep. 25, 2019, 11 pages.

*Primary Examiner* — Nicole Coy
(74) *Attorney, Agent, or Firm* — Kilpatrick Townsend & Stockton LLP

(57) ABSTRACT

Certain aspects and features of the disclosure relate to a hydraulic connector for use in a wellbore, for example, with or as part of a disconnect tool. The hydraulic connector can isolate hydraulic fluids in upper and lower hydraulic lines using hydraulic pistons. The pistons in the upper and lower parts of the hydraulic connector interconnect mechanically when the connector is engaged and communicate pressure without transferring hydraulic fluid across the interface. The hydraulic fluid can therefore remain confined within the upper and lower hydraulic lines even when the disconnect tool is disengaged, reducing or eliminating incidents of hydraulic fluid leaking or spilling into the wellbore.

20 Claims, 6 Drawing Sheets

(56) References Cited

U.S. PATENT DOCUMENTS

| | | | | |
|---|---|---|---|---|
| 6,357,529 | B1 * | 3/2002 | Kent | E21B 34/04 166/344 |
| 6,502,640 | B2 * | 1/2003 | Rayssiguier | E21B 23/006 166/375 |
| 6,776,636 | B1 | 8/2004 | Cameron et al. | |
| 7,347,270 | B2 | 3/2008 | McMillan et al. | |
| 8,066,075 | B2 | 11/2011 | Cowie et al. | |
| 8,074,721 | B2 | 12/2011 | Guven et al. | |
| 8,360,158 | B2 | 1/2013 | Mandrou et al. | |
| 8,851,175 | B2 * | 10/2014 | Onadeko | E21B 31/00 166/301 |
| 8,905,139 | B2 | 12/2014 | Arizmendi et al. | |
| 9,388,664 | B2 | 7/2016 | Teale et al. | |
| 9,404,326 | B2 * | 8/2016 | Zhou | E21B 21/08 |
| 2011/0056702 | A1 | 3/2011 | Sharma et al. | |
| 2013/0284453 | A1 | 10/2013 | Vick, Jr. et al. | |
| 2017/0145777 | A1 | 5/2017 | Vasques et al. | |
| 2017/0234113 | A1 * | 8/2017 | Steele | E21B 17/028 166/381 |

* cited by examiner

FLUID-FREE HYDRAULIC CONNECTOR

TECHNICAL FIELD

The present disclosure relates generally to devices for use downhole in wells. More specifically, but not by way of limitation, this disclosure relates to a hydraulic connector that can provide an interface between hydraulic devices in upper and lower completions in a well.

BACKGROUND

Wellbores are sometimes drilled into subterranean formations that contain hydrocarbons to recover the hydrocarbons. Some wellbore servicing methods employ wellbore tubulars that are conveyed within the wellbore for various purposes, such as producing the hydrocarbons from the wellbore, throughout the life of the wellbore. The wellbore tubulars may be retrieved from the wellbore for a variety of purposes. For example, the wellbore tubular may be retrieved from the wellbore to replace or repair the wellbore tubular, perform a servicing operation on downhole equipment, or abandon the wellbore.

Some wellbore tubulars may be retrieved in components to allow a portion of the wellbore tubular to remain in the wellbore. For example, an upper portion of the wellbore tubular and associated control lines and devices is sometimes referred to as an upper completion. A lower portion of the wellbore tubular and associated control lines and devices is sometimes referred to as a lower completion. A disconnect tool can connect the upper completion and the lower completion and can allow the completions to be disconnected from the surface so that the upper completion can be removed as needed. Each time the upper completion is positioned into the wellbore or retrieved from the wellbore, care is taken to prevent damage to the wellbore, the wellbore tubular, the associated control lines, or the connection hardware.

DETAILED DESCRIPTION

Certain aspects and features relate to a hydraulic connector that can reduce or eliminate hydraulic fluid leakage that would otherwise occur around hydraulic connections, for example, when an upper and lower completion are separated at a disconnect tool. In certain aspects, a hydraulic coupling in or on the disconnect tool includes one or more hydraulic connectors that can isolate hydraulic fluids in the upper completion and lower completion using hydraulic pistons. The pistons in the upper and lower parts of a hydraulic connector interconnect mechanically when the connector is engaged and communicate pressure without transferring hydraulic fluid across the interface between upper and lower portions of the hydraulic connector. The hydraulic fluid can therefore remain confined within upper and lower hydraulic lines even when the disconnect tool is disengaged or hydraulic lines are separated, reducing or eliminating incidents of hydraulic fluid leaking into the wellbore. The necessity to periodically replace hydraulic seals can also be reduced or eliminated.

In one example, a hydraulic connector includes an upper portion, a lower portion, and a detachable pair of pistons connectable to a hydraulic control line and a downhole hydraulic line. The pair of pistons communicate pressure between the hydraulic control line and the downhole hydraulic line. One piston of the detachable pair of pistons is separable from the other piston of the detachable pair of pistons when the upper portion of the hydraulic connector is separated from the lower portion of the hydraulic connector. However, the pistons can confine the hydraulic fluid within the hydraulic control line and the downhole hydraulic line.

In some examples, the hydraulic coupling includes two or more hydraulic connectors each connectable to one of multiple hydraulic control lines. In some examples, each detachable pair of pistons includes a push rod fixed to one piston and detachable from the other piston of the pair. The hydraulic connectors can be designed as part of a hydraulic coupling of a downhole disconnect tool, where the upper portion and the lower portion of a hydraulic connector are separable with an upper portion and a lower portion of the disconnect tool.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
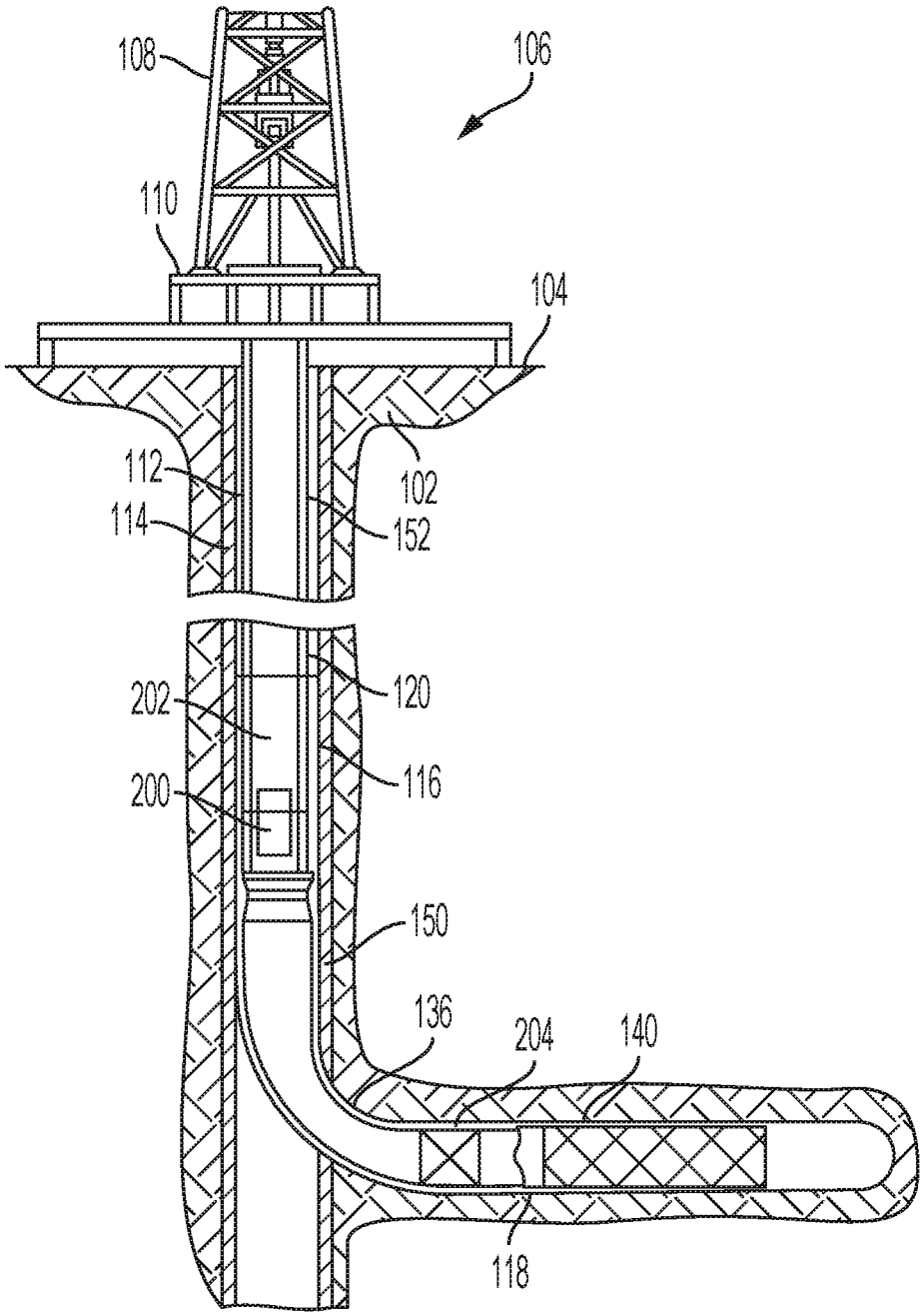
FIG. 1 is a schematic, cross-sectional view of a wellbore operating environment according to some aspects of the present disclosure.

FIG. 1 is a schematic, cross-sectional view of a wellbore operating environment according to some aspects. The operating environment includes a drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multilateral wellbore, and any other type of wellbore for drilling and completing one or more production zones. Further, the wellbore may be used for both producing wells and injection wells.

A wellbore tubular string 120 including hydraulic coupling 200 disposed in or on disconnect tool 202 may be lowered into the subterranean formation 102 for a variety of servicing or treatment procedures throughout the life of the wellbore. Hydraulic coupling 200 includes hydraulic connectors according to certain aspects, as will be discussed in detail below. The embodiment shown in FIG. 1 illustrates the wellbore tubular 120 in the form of a production tubing string being lowered into the subterranean formation with the disconnect tool 202. It should be understood that the wellbore tubular 120 including the disconnect tool 202 is equally applicable to any type of wellbore tubular being inserted into a wellbore, including as non-limiting examples production tubing and coiled tubing. The hydraulic coupling 200 may also be used to connect and provide a pressure pathway for various other downhole components (e.g., various downhole subs, pumps, and servicing tools). Interval control valve 204 is an example of a downhole device or tool that can be activated through the hydraulic coupling 200. Interval control valve 204 operates by movement of a carbide carrier sleeve that is moved by hydraulic force.

The drilling rig 106 includes a derrick 108 with a rig floor 110 through which the wellbore tubular 120 extends downward from the drilling rig 106 into the wellbore 114. The drilling rig 106 includes a motor driven winch and other associated equipment for extending the wellbore tubular 120 into the wellbore 114 to position the wellbore tubular 120 within the wellbore 114. For example, the wellbore tubular 120 may including the disconnect tool 202 including the hydraulic coupling 200 that is initially extended into the wellbore, or the wellbore tubular 120 may include an upper portion of the disconnect tool 202 being extended into the wellbore 114 for engagement with a lower portion of the disconnect tool 202. While the operating environment depicted in FIG. 1 refers to a stationary drilling rig 106 for lowering and positioning the wellbore tubular 120 including the disconnect tool 202 with the hydraulic coupling 200 within a land-based wellbore 114, in alternative embodiments, mobile workover rigs, wellbore servicing units (such as coiled tubing units), and the like may be used to lower the wellbore tubular 120. It should be understood that a wellbore tubular 120 including the disconnect tool may alternatively be used in other operational environments, such as within an offshore wellbore operational environment. In alternative operating environments, a vertical, deviated, or horizontal wellbore portion may be cased and cemented and/or portions of the wellbore may be uncased. For example, uncased section 140 may include a section of the wellbore 114 ready for being cased or used as an open-hole production zone. In some aspects, a wellbore tubular 120 including the disconnect tool 202 with the hydraulic connector 200 may be used in a cased or uncased wellbore.

Regardless of the type of operational environment in which the wellbore tubular 120 including the hydraulic coupling 200 is used, it will be appreciated that in one or more embodiments, the hydraulic connectors within coupling 200 serve to provide a retrievable connection that allows hydraulic pressure pathways to be established between an upper completion and a lower completion. In some aspects, disconnect tool also contains an additional connector or connectors that may also allow one or more releasable electrical connections. The disconnect tool 202 engages between upper completion 152 and a lower completion 150.

Figure 2:
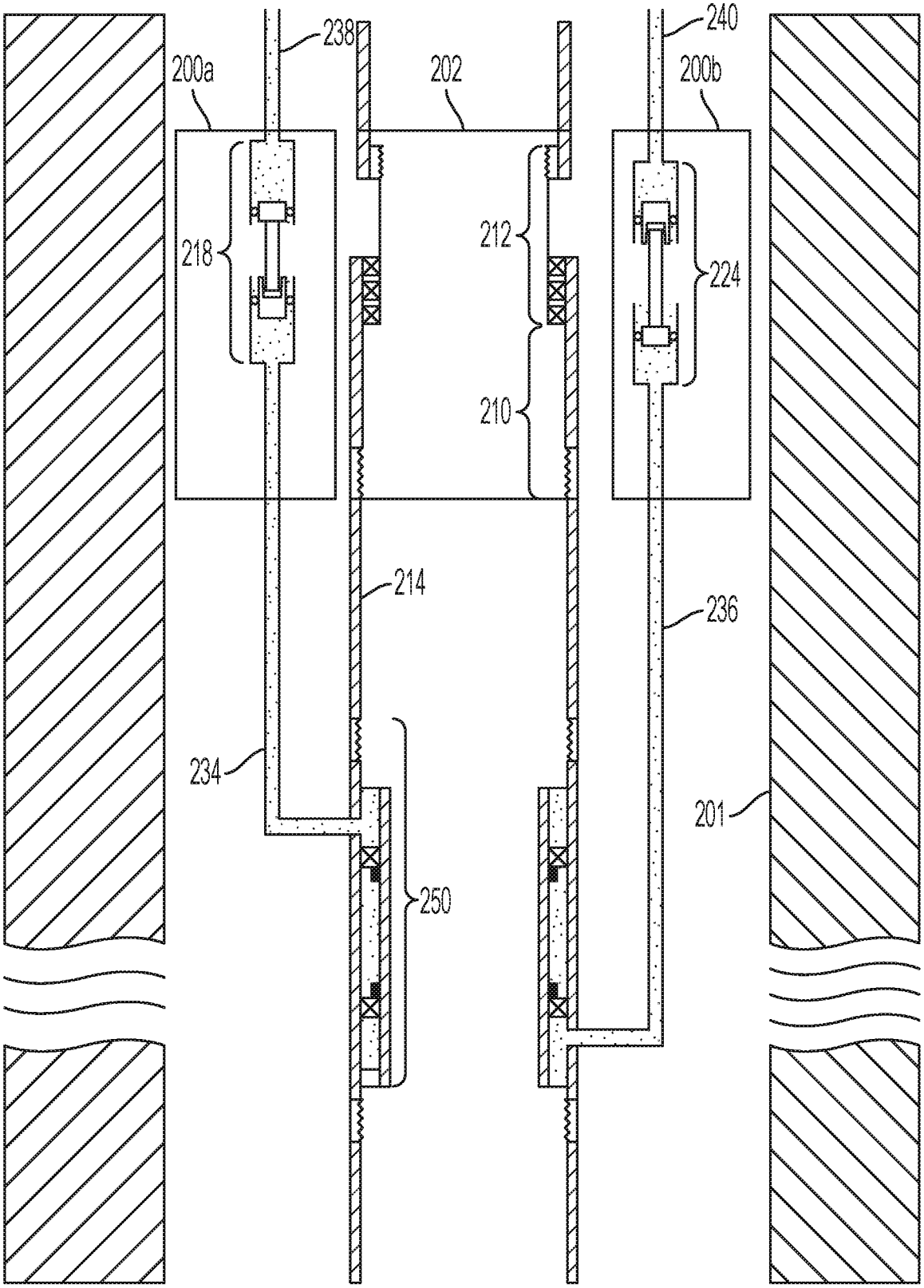
FIG. 2 is a schematic diagram of a disconnect tool with a hydraulic coupling according to some aspects of the present disclosure.

FIG. 2 is a schematic diagram of the hydraulic connectors 200*a* and 200*b* that provide the hydraulic coupling 200 of FIG. 1 according to some aspects of the present disclosure, wherein the hydraulic connectors are shown in an engaged or connected state. Hydraulic connectors 200*a* and 200*b* are shown with disconnect tool 202 of FIG. 1, which includes a lower portion 210 and an upper portion 212. Wellbore tubing 214 is also shown in FIG. 2. Wellbore tubing 214 together with the internal wall of disconnect tool 202 define a flow bore. The flow bore allows production or other fluid to flow through the disconnect tool. Each hydraulic connector 200*a* and 200*b* includes a detachable pair of pistons that provide a pressure interface across the boundary between lower portion 210 and upper portion 212 of disconnect tool 202. A first detachable pair of pistons 218 is disposed in hydraulic connector 200*a*. A second detachable pair of pistons is disposed in hydraulic connector 200*b*.

Continuing with FIG. 2, for purposes of this discussion, uphole is in an upward direction when viewing FIG. 2 and downhole is in a downward direction. An uphole portion of the hydraulic connector 200*a* is connected to first hydraulic control line 238 and an uphole portion of hydraulic connector 200*b* is connected to second hydraulic control line 240. The first and second hydraulic control lines are in fluid communication with equipment (not shown) at surface 104. The uphole portions of the hydraulic connectors 200*a* and 200*b* are associated with the upper portion 212 of disconnect tool 202, which is in turn attached to upper completion 152 of FIG. 1. The downhole portions of the hydraulic connectors 200*a* and 200*b* are associated with lower portion 210 of disconnect tool 202, which is in turn associated with lower completion 150 of FIG. 1. In referring to portions of the hydraulic connector or of the disconnect tool herein, the terms upper, uphole, and first are interchangeable and intended as relative terms for convenience of description. The terms downhole, lower, and second are also interchangeable as are the terms first and second. These devices can be oriented in many different ways and function the same.

In the embodiment of FIG. 2, the hydraulic connector 200*a* is in fluid communication with interval control valve (ICV) 250 through a first downhole hydraulic line 234 and the hydraulic connector 200*b* is in fluid communication with ICV 250 through a second downhole hydraulic line 236. ICV 250 in this embodiment includes a carbide carrier 252 that moves up and down in response to pressure in the first and second hydraulic control lines 238 and 240, as will be described in further detail with respect to FIGS. 4 and 5. ICV 250 has connections (not shown) to other downhole equipment and devices.

Figure 3:
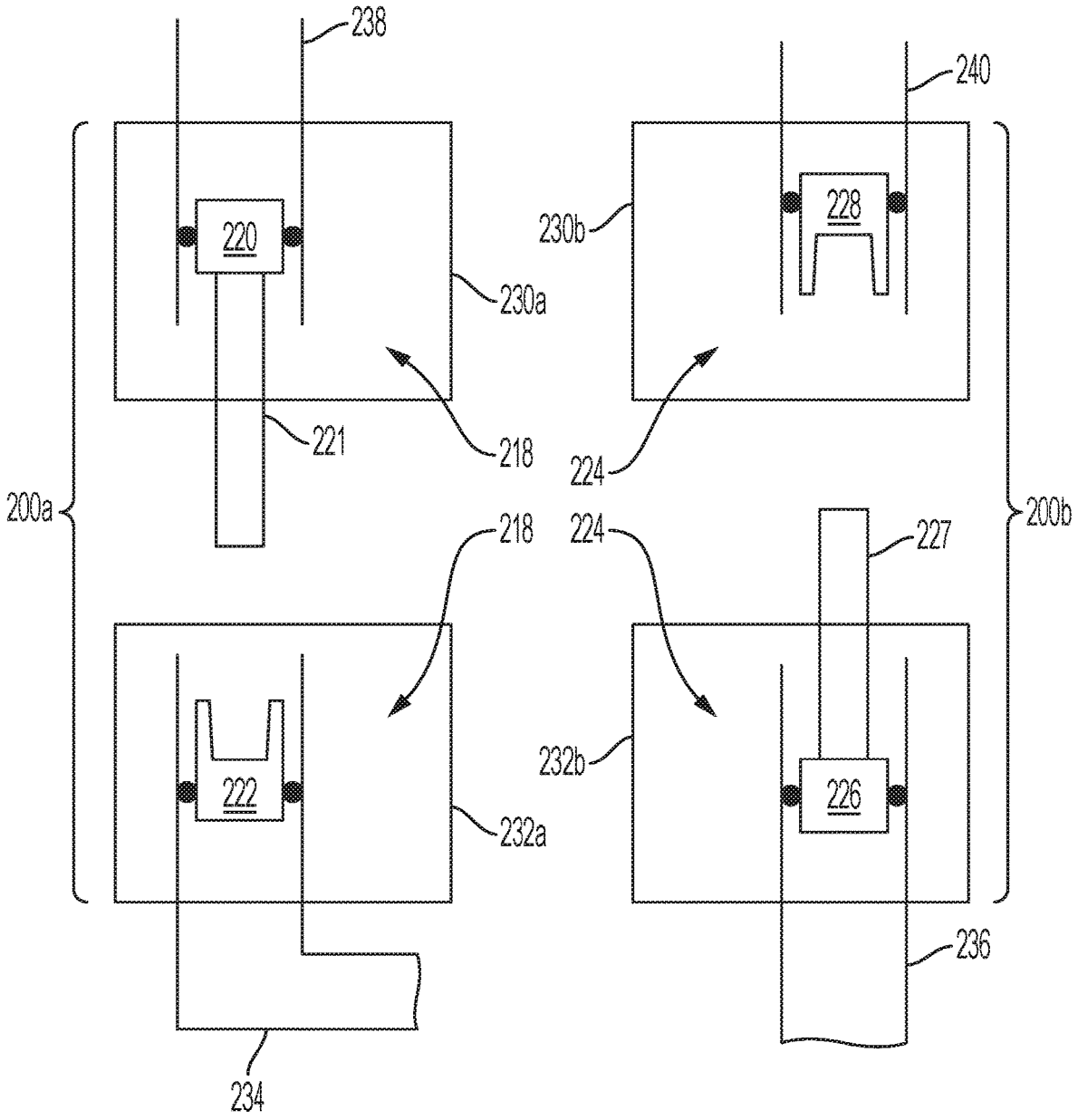
FIG. 3 is a schematic diagram of the hydraulic coupling according to some aspects of the present disclosure, with hydraulic connectors shown in a disconnected state.

FIG. 3 is a schematic diagram of the hydraulic connectors 200*a* and 200*b* according to some aspects of the present disclosure, wherein the hydraulic connectors 200*a* and 200*b* are shown in a disconnected state. In FIG. 3, upper portion 230*a* of hydraulic connector 200*a* has been disengaged with lower portion 232*a* of hydraulic connector 200*a*. First detachable piston 222 has detached from a push rod 221, and second detachable piston 228 has detached from a push rod 227. In some embodiments, the hydraulic coupling and the included hydraulic connectors engage when disconnect tool 202 engages to join an upper and lower completion and detaches when the disconnect tool 202 disengages so that the upper completion 152 can be withdrawn from the wellbore 114 while leaving a lower completion 150 in place.

Continuing with FIG. 3, the detachable pair of pistons 218 includes detachable piston 222. Detachable piston 222 is detachably connected to a second end of push rod 221.

Detachable pair of pistons 218 also includes fixed piston 220 to which push rod 221 is fixedly attached. The detachable pair of pistons 224 includes fixed piston 226 fixedly connected to a first end of push rod 227, and a detachable piston 228 that is detachably connected to a second end of push rod 227. The detachably attached and fixedly attached pistons are operable to be oriented in opposite directions along an axis of the wellbore and the disconnect tool as between the two detachable piston pairs in the two hydraulic connectors that are part of the hydraulic coupling. Such an arrangement provides a way to key the hydraulic coupling so that it only connects one way.

Still referring to FIG. 3, when the hydraulic coupling engages, detachable piston 222 connects with push rod 221, and detachable piston 228 connects with push rod 227. When the hydraulic coupling disengages, detachable piston 222 detaches from push rod 221, and detachable piston 228 detaches from push rod 227, however, the pistons can confine the hydraulic fluid within the hydraulic lines. It should be noted that a hydraulic connector could be made to work with a different type of mechanical connection between pistons of a piston pair. For example, push rods that are in two detachable parts could be used. If the detachable parts are made different lengths, a hydraulic coupling would still be keyed. Alternatively, a separate mechanism could be used to key the hydraulic coupling.

Figure 4:
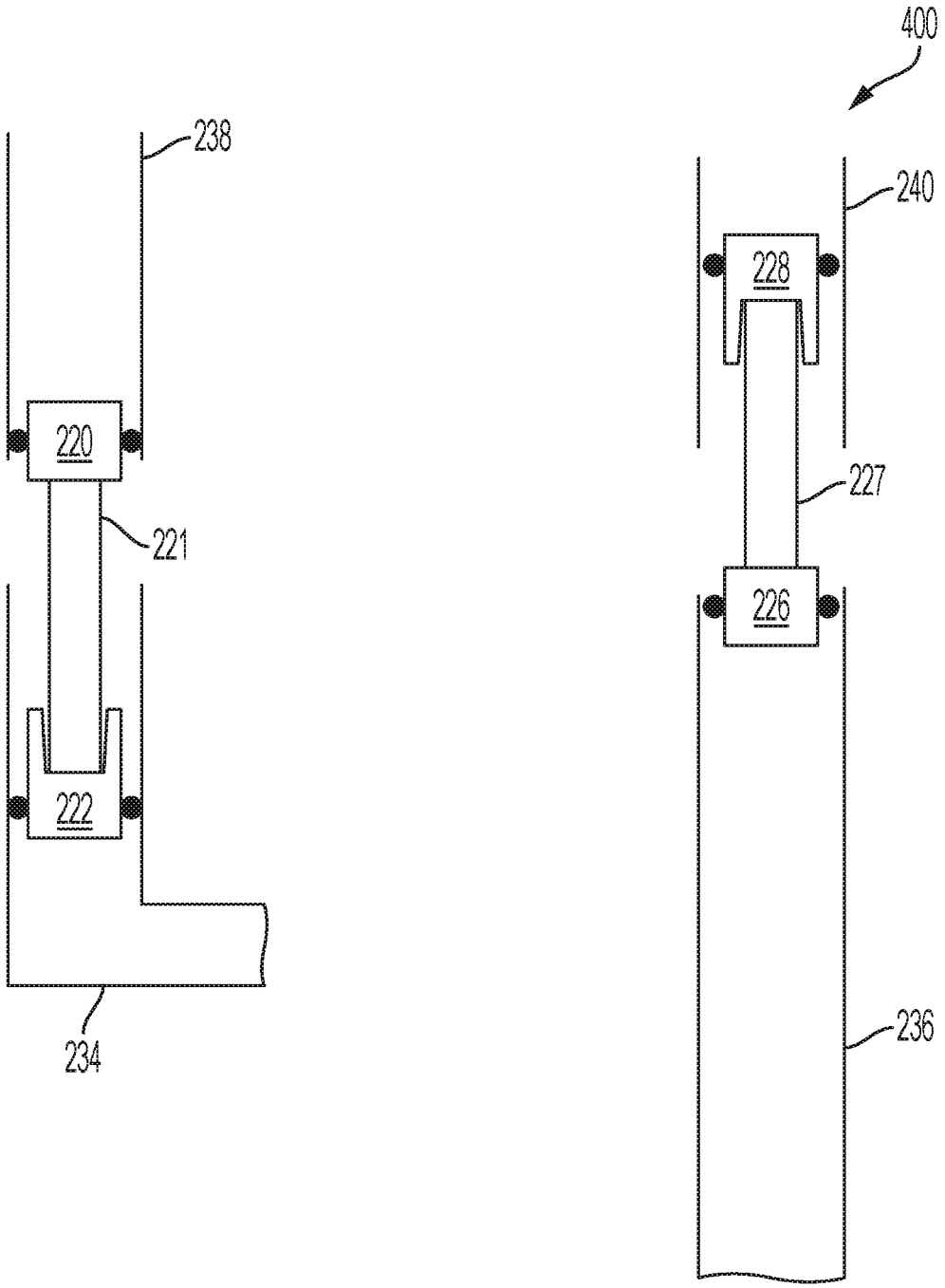
FIG. 4 is a schematic diagram of the hydraulic connectors according to some aspects of the present disclosure, wherein the hydraulic connectors are connected and in a state that creates operational fluid pressure in a downhole hydraulic line.
Figure 5:
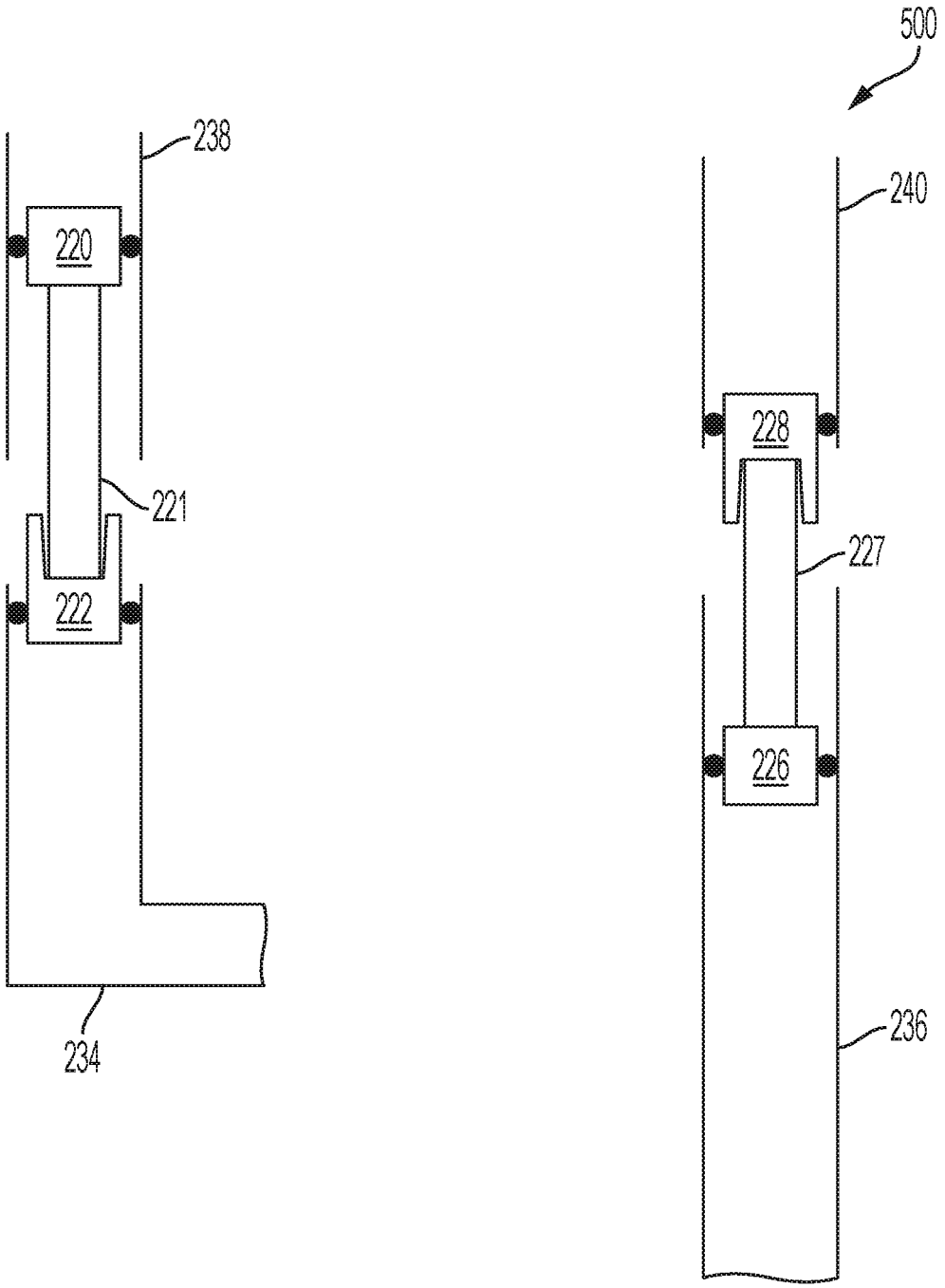
FIG. 5 is a schematic diagram of the hydraulic connectors according to some aspects of the present disclosure, wherein the hydraulic connectors are operating in a state that creates operational fluid pressure downhole in another downhole hydraulic line.

FIG. 4 and FIG. 5 illustrate one or more embodiments of the piston pairs of the hydraulic connectors in two different states of operation. For purposes of this example, it can be assumed that first hydraulic control line 238 serves as a control line to open ICV 250 and second hydraulic control line 240 serves as a hydraulic control line to close ICV 250. FIG. 4 shows the valve and piston arrangement 400 in the wellbore 114 when the first hydraulic control line 238 is pressurized. In FIG. 4, the first hydraulic control line 238 is pressurized from the surface, which will move pistons 220 and 222, now mechanically linked, downhole. This motion transmits hydraulic force from the hydraulic connector 200*a* downhole through downhole hydraulic line 234 and will ultimately push carbide carrier 252, opening ICV 250. At the same time, this action causes hydraulic pressure to build up on the downhole hydraulic line 236, which pushes pistons 228 and 226 uphole and causes pressure in the second hydraulic control line 240 to bleed off.

FIG. 5 shows the valve and piston arrangement 500 in the wellbore when the close control line is pressurized from the surface. In FIG. 5, the second hydraulic control line 240 is pressurized from the surface, which will move pistons 226 and 228, now mechanically linked, downhole. This motion transmits the hydraulic force from the hydraulic connector 200*b* downhole through downhole hydraulic line 236 and ultimately will push carbide carrier 252 upward, closing ICV 250. At the same time, this action causes hydraulic pressure to build up on the downhole hydraulic line 234, which pushes pistons 220 and 222 uphole and causes pressure in the first hydraulic control line 238 to bleed off.

Figure 6:
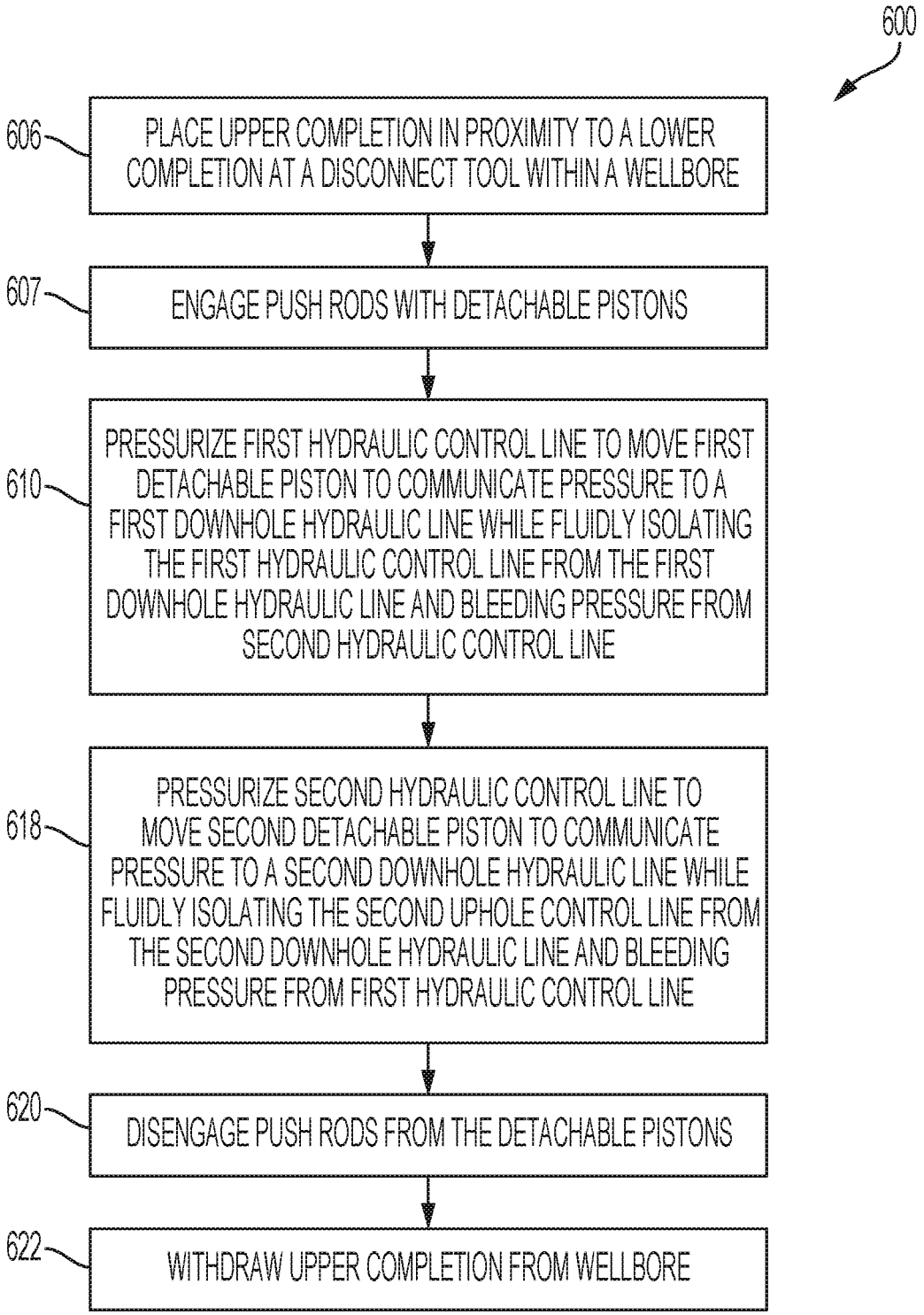
FIG. 6 is a flowchart illustrating the method of operating a disconnect tool with a hydraulic coupling according to some aspects of the present disclosure.

FIG. 6 is a flowchart illustrating the method 600 of operation of a disconnect tool with hydraulic connectors according to some aspects of the present disclosure. Reference will be made to the equipment and components in the other drawings. At block 606, the upper completion 152 is placed in the wellbore 114 in proximity to the lower completion 150 at the disconnect tool 202. At block 607, the push rods 221 and 227 are engaged with detachable pistons 222 and 228. At block 610, the first hydraulic control line 238 is pressurized to move first detachable piston 222 to communicate pressure to a first downhole hydraulic line 234 while fluidly isolating the first hydraulic control line 238 from the first downhole hydraulic line 234. This action also bleeds pressure from second hydraulic control line 240. At block 618, the second hydraulic control line 240 is pressurized to move the second detachable piston 228 to communicate pressure to a second downhole hydraulic line 236 while fluidly isolating the second hydraulic control line 240 from the second downhole hydraulic line 236. This action also bleeds pressure from first hydraulic control line 238. These operations may be repeated to activate (open or close) the ICV as needed. At block 620 push rods 221 and 227 are disengaged from detachable pistons 222 and 228. At block 622, upper completion 152 is withdrawn from wellbore 114.

Terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprises" or "comprising," when used in this specification, specify the presence of stated features, steps, operations, elements, or components, but do not preclude the presence or addition of one or more other features, steps, operations, elements, components, or groups thereof. Additionally, comparative, quantitative terms such as "above" and "below" are intended to encompass the concept of equality.

It should also pointed out that references made in this disclosure to figures and descriptions using positional terms such as, but not limited to, "left," "right," "upper," "uphole," "lower," and "downhole" refer only to the relative position of features as shown from the perspective of the reader. Such terms are not meant to imply any absolute positions. An element can be functionally in the same place in an actual device, even though one might refer to the position of the element differently due to the instant orientation of the device. Indeed, the hydraulic connector described herein may be oriented in any direction, especially when not in use, and the terminology, therefore, should be understood as encompassing such variations unless specified otherwise. Elements that are described as "connected," "coupled," "couplable," or "connectable" can be connected directly or through intervening elements. Elements referred to as "connected" or "coupled" may be either connected or merely capable of being connected.

In some aspects, a hydraulic connector for a disconnect tool is provided according to one or more of the following examples. As used below, any reference to a series of examples is to be understood as a reference to each of those examples disjunctively (e.g., "Examples 1-4" is to be understood as "Examples 1, 2, 3, or 4").

Example 1. A hydraulic connector for use in a wellbore, the hydraulic connector including an uphole portion, a downhole portion, and a detachable pair of pistons connectable to a hydraulic control line and a downhole hydraulic line to communicate pressure therebetween. A first piston of the detachable pair of pistons is separable from a second piston of the detachable pair of pistons in response to the uphole portion of the hydraulic connector separating from the downhole portion of the hydraulic connector, while confining hydraulic fluid within the hydraulic control line and the downhole hydraulic line.

Example 2. The hydraulic connector of example 1 further including a push rod, the push rod including a first end connected to the first piston and a second end connected to the second piston.

Example 3. The hydraulic connector of example(s) 1-2 wherein the push rod includes two detachable parts.

Example 4. The hydraulic connector of example(s) 1-3 wherein the first piston is fixedly connected to the first end of the push rod and the second piston is detachably connected to the second end of the push rod.

Example 5. The hydraulic connector of example(s) 1-4 configured to be used in a hydraulic coupling including multiple hydraulic connectors, wherein the fixedly and detachably connected pistons are oriented in opposite directions among the plurality of hydraulic connectors.

Example 6. The hydraulic connector of example(s) 1-5 wherein the uphole portion and the downhole portion are operable to be respectively separable with an upper portion and a lower portion of a disconnect tool.

Example 7. A method of operating a disconnect tool includes placing an upper completion in proximity to a lower completion at a disconnect tool within a wellbore, engaging a first push rod with a first detachable piston and a second push rod with a second detachable piston, the first detachable piston and the second detachable piston being disposed in a hydraulic coupling of the disconnect tool, pressurizing a first hydraulic control line in fluid communication with the first detachable piston to move the first detachable piston to communicate pressure to a first downhole hydraulic line while fluidly isolating the first hydraulic control line from the first downhole hydraulic line, and pressurizing a second hydraulic control line in fluid communication with the second detachable piston to move the second detachable piston to communicate pressure to a second downhole hydraulic line while fluidly isolating the second hydraulic control line from the second downhole hydraulic line.

Example 8. The method of example 7 further including disengaging the first push rod from the first detachable piston and the second push rod from the second detachable piston while confining hydraulic fluid to the first hydraulic control line, the second hydraulic control line, the first downhole hydraulic line, and the second downhole hydraulic line; and withdrawing the upper completion from the wellbore.

Example 9. The method of example(s) 7-8 further including moving a first fixed piston with the first detachable piston; and moving a second fixed piston with the second detachable piston.

Example 10. The method of example(s) 7-9 further including moving a first push rod with the first fixed piston and the first detachable piston, and moving a second push rod with the second fixed piston and the second detachable piston.

Example 11. The method of example(s) 7-10 further including bleeding pressure from the second hydraulic control line while pressuring the first hydraulic control line, and bleeding pressure from the first hydraulic control line while pressurizing the second hydraulic control line.

Example 12. The method of example(s) 7-11 further including activating a downhole device or tool in response to applying pressure to the first or second downhole hydraulic line.

Example 13. The method of example(s) 7-12 wherein the downhole device or tool comprises an interval control valve.

Example 14. The method of example(s) 7-13 wherein activating the interval control valve further comprises moving a carbide carrier.

Example 15. A disconnect tool for use in a wellbore, the disconnect tool including an internal wall at least partially defining a flow bore to allow production fluid to pass through the disconnect tool between an upper completion and a lower completion, and a hydraulic coupling operable to be in fluid communication with at least one hydraulic control line associated with the upper completion and at least one downhole hydraulic line associated with the lower completion while fluidly isolating the at least one hydraulic control line and the at least one downhole hydraulic line and communicating pressure downhole.

Example 16. The disconnect tool of example 15 wherein the hydraulic coupling includes a plurality of hydraulic connectors, each hydraulic connector connected to a hydraulic control line and a downhole hydraulic line.

Example 17. The disconnect tool of example(s) 15-16 wherein the hydraulic control line leads to a surface of a formation, and wherein the disconnect tool further includes a detachable pair of pistons associated with each of the plurality of hydraulic connectors.

Example 18. The disconnect tool of example(s) 15-17 wherein the detachable pair of pistons includes a push rod. The push rod includes a first end and a second end, a fixed piston connected to the first end of the push rod, and a detachable piston connected to the second end of the push rod.

Example 19. The disconnect tool of example(s) 15-18 wherein the fixed piston is fixedly connected to the first end of the push rod and the detachable piston is detachably connected to the second end of the push rod.

Example 20. The disconnect tool of example(s) 15-19 wherein the first end of the push rod of a first detachable pair of pistons is oriented in an opposite direction from the first end of the push rod of a second detachable pair of pistons relative to an axis of the disconnect tool.

The foregoing description of the examples, including illustrated examples, has been presented only for the purpose of illustration and description and is not intended to be exhaustive or to limit the subject matter to the precise forms disclosed. Numerous modifications, combinations, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A hydraulic connector for use in a wellbore, the hydraulic connector comprising:

an uphole portion;

a downhole portion; and a detachable pair of pistons connectable to a hydraulic control line and a downhole hydraulic line to communicate pressure therebetween;

wherein a first piston of the detachable pair of pistons is separable from a second piston of the detachable pair of pistons in response to the uphole portion of the hydraulic connector separating from the downhole portion of the hydraulic connector, while confining hydraulic fluid within the hydraulic control line and the downhole hydraulic line.

2. The hydraulic connector of claim 1 further comprising a push rod including a first end connected to the first piston and a second end connected to the second piston.

3. The hydraulic connector of claim 2 wherein the push rod comprises two detachable parts.

4. The hydraulic connector of claim 2 wherein the first piston is fixedly connected to the first end of the push rod and the second piston is detachably connected to the second end of the push rod.

5. The hydraulic connector of claim 4 configured to be used in a hydraulic coupling comprising a plurality of hydraulic connectors, wherein the fixedly and detachably connected pistons are oriented in opposite directions among the plurality of hydraulic connectors.

6. The hydraulic connector of claim 1 wherein the uphole portion and the downhole portion are operable to be respectively separable with an upper portion and a lower portion of a disconnect tool.

7. A method of operating a disconnect tool, the method comprising:

placing an upper completion in proximity to a lower completion at a disconnect tool within a wellbore;

engaging a first push rod with a first detachable piston and a second push rod with a second detachable piston, the first detachable piston and the second detachable piston being disposed in a hydraulic coupling of the disconnect tool;

pressurizing a first hydraulic control line in fluid communication with the first detachable piston to move the first detachable piston to communicate pressure to a first downhole hydraulic line while fluidly isolating the first hydraulic control line from the first downhole hydraulic line; and pressurizing a second hydraulic control line in fluid communication with the second detachable piston to move the second detachable piston to communicate pressure to a second downhole hydraulic line while fluidly isolating the second hydraulic control line from the second downhole hydraulic line.

8. The method of claim 7 further comprising:

disengaging the first push rod from the first detachable piston and the second push rod from the second detachable piston while confining hydraulic fluid to the first hydraulic control line, the second hydraulic control line, the first downhole hydraulic line, and the second downhole hydraulic line; and withdrawing the upper completion from the wellbore.

9. The method of claim 7 further comprising:

moving a first fixed piston with the first detachable piston; and moving a second fixed piston with the second detachable piston.

10. The method of claim 9 further comprising:

moving a first push rod with the first fixed piston and the first detachable piston; and moving a second push rod with the second fixed piston and the second detachable piston.

11. The method of claim 7 further comprising:

bleeding pressure from the second hydraulic control line while pressuring the first hydraulic control line; and bleeding pressure from the first hydraulic control line while pressurizing the second hydraulic control line.

12. The method of claim 7 further comprising activating a downhole device or tool in response to applying pressure to the first or second downhole hydraulic line.

13. The method of claim 12 wherein the downhole device or tool comprises an interval control valve.

14. The method of claim 13 wherein activating the interval control valve further comprises moving a carbide carrier.

15. A disconnect tool for use in a wellbore, the disconnect tool comprising:

an internal wall at least partially defining a flow bore to allow production fluid to pass through the disconnect tool between an upper completion and a lower completion; and a hydraulic coupling operable to be in fluid communication with at least one hydraulic control line associated with the upper completion and at least one downhole hydraulic line associated with the lower completion while fluidly isolating the at least one hydraulic control line and the at least one downhole hydraulic line and communicating pressure downhole, wherein the hydraulic coupling comprises a plurality of hydraulic connectors, each hydraulic connector connected to a hydraulic control line and a downhole hydraulic line, and wherein the hydraulic control line leads to a surface of a formation; and wherein the disconnect tool further comprises a detachable pair of pistons associated with each of the plurality of hydraulic connectors.

16. The disconnect tool of claim 15 wherein the detachable pair of pistons comprises:

a push rod including a first end and a second end;

a fixed piston connected to the first end of the push rod; and a detachable piston connected to the second end of the push rod.

17. The disconnect tool of claim 16 wherein the fixed piston is fixedly connected to the first end of the push rod and the detachable piston is detachably connected to the second end of the push rod.

18. The disconnect tool of claim 17 wherein the first end of the push rod of a first detachable pair of pistons is oriented in an opposite direction from the first end of the push rod of a second detachable pair of pistons relative to an axis of the disconnect tool.

19. The disconnect tool of claim 15 wherein the detachable pair of pistons comprises:

a push rod;

a fixed piston coupled to the push rod; and a detachable piston coupled to the push rod.

20. The disconnect tool of claim 19 wherein the fixed piston is fixedly connected to a first end of the push rod and the detachable piston is detachably connected to a second end of the push rod.

* * * * *